United States Patent [19]

Ruff

[11] Patent Number: 5,012,292

[45] Date of Patent: Apr. 30, 1991

[54] DEVICE FOR SETTING THE ROTOR OF A ROTARY SWITCH

[75] Inventor: Gerd Ruff, Heidelberg, Fed. Rep. of Germany

[73] Assignee: Teldix GmbH, Heidelberg, Fed. Rep. of Germany

[21] Appl. No.: 249,372

[22] PCT Filed: Mar. 25, 1987

[86] PCT No.: PCT/EP87/00165

§ 371 Date: Sep. 26, 1988

§ 102(e) Date: Sep. 26, 1988

[87] PCT Pub. No.: WO87/06063

PCT Pub. Date: Oct. 8, 1987

[30] Foreign Application Priority Data

Mar. 26, 1986 [DE] Fed. Rep. of Germany ..... 3610228

[51] Int. Cl.[5] ..... H01F 7/08

[52] U.S. Cl. ..... 335/253; 333/106; 333/108; 335/254

[58] Field of Search ..... 335/272; 333/101, 105, 333/106, 108; 310/156

[56] References Cited

U.S. PATENT DOCUMENTS

| | | | |
|---|---|---|---|
| 3,141,943 | 7/1964 | Lanctot . | |
| 3,344,378 | 9/1967 | Wilhelmson . | |
| 4,317,972 | 3/1982 | Kiellberg . | |
| 4,447,793 | 5/1984 | Gray . | |
| 4,628,199 | 12/1986 | Mueller et al. | 335/272 X |
| 4,633,201 | 12/1986 | Ruff . | |

FOREIGN PATENT DOCUMENTS

| | | |
|---|---|---|
| 0147610 | 11/1984 | European Pat. Off. . |
| 1809189 | 4/1960 | Fed. Rep. of Germany . |
| 3315682 | 11/1983 | Fed. Rep. of Germany . |
| 3441728 | 7/1985 | Fed. Rep. of Germany . |
| 3526507 | 2/1986 | Fed. Rep. of Germany . |

OTHER PUBLICATIONS

PCT, WO87/00349, 1-15-87.

Universitätsbibliothek Hannover und Technische Informationsbibliothek, IBM Technical Disclosure.

*Primary Examiner*—George Harris

*Attorney, Agent, or Firm*—Spencer & Frank

[57] ABSTRACT

Device for setting the rotor of a rotary switch in one of three possible switching positions (positions 1 to 3). Such rotary switches can be for example wave guide or coaxial switches. The excitation of windings in this device for a rotary direction is effected by a pair of conductors with a current pulse. This current pulse, via an initial drive system and by means of a drive torque produced by the windings of the latter, moves the rotor from an initial end position (position 1) in the direction of a mid-position (position 3) and to an intermediate position. After the current pulse has been switched off, a permanently imprinted magnetic detent torque brings about the further rotation of the rotor to the mid-position (position 3), where the rotor is centered by the shape of the detent torque. A further current pulse on the same pair of conductors produces a drive moment which moves the rotor from the mid-position (position 3) to the other end position (position 2).

8 Claims, 3 Drawing Sheets

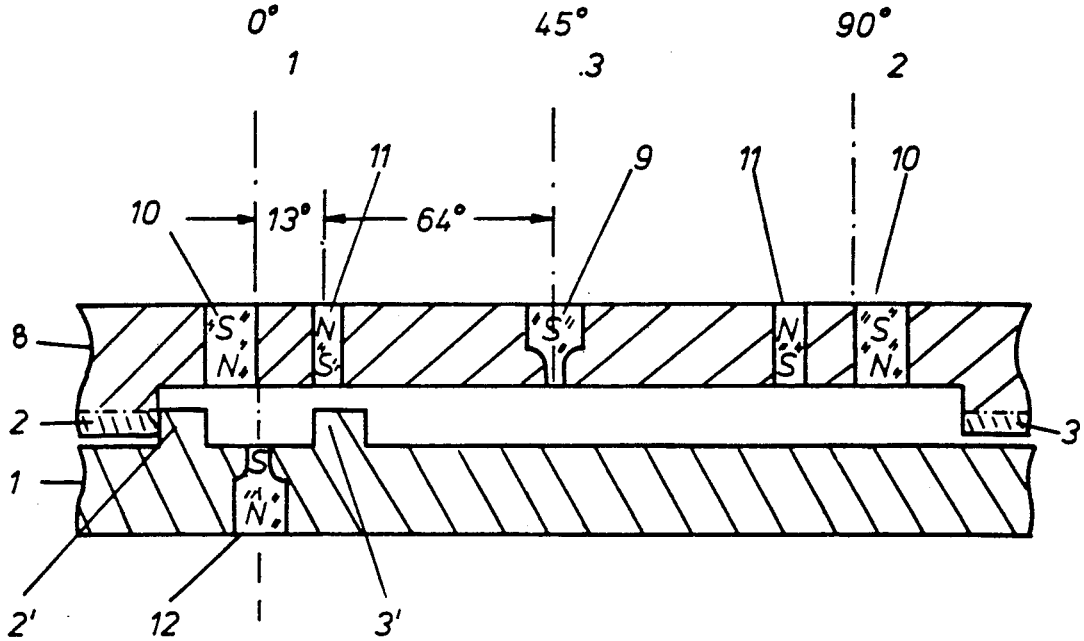
Fig.6a
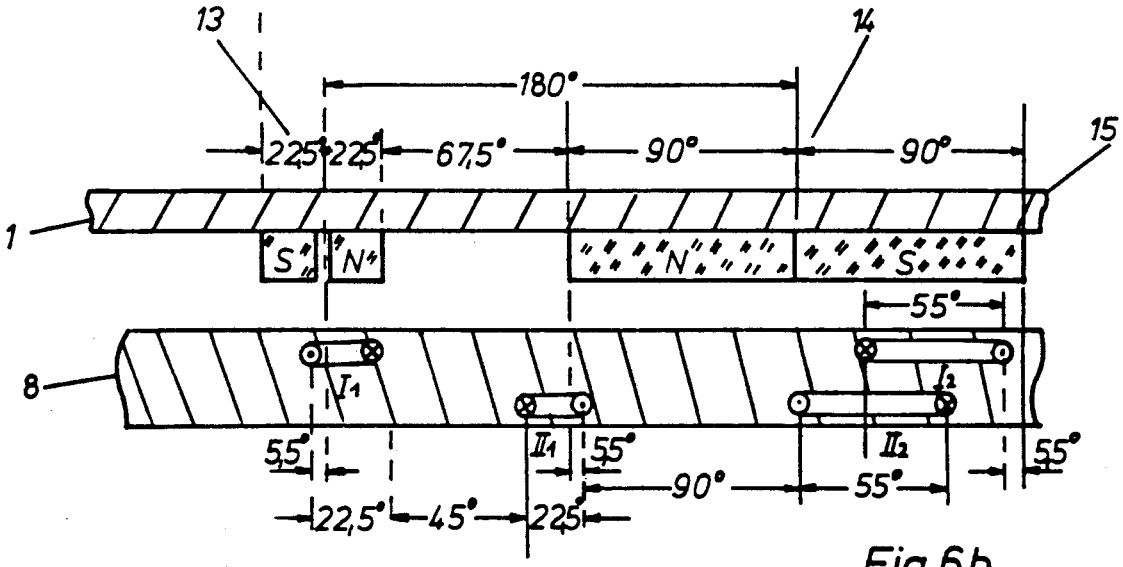
Fig.6b
Fig.6

DEVICE FOR SETTING THE ROTOR OF A ROTARY SWITCH

BACKGROUND OF THE INVENTION

The invention relates to a device for setting the rotor of a rotary switch into three possible positions.

Such devices are required, for example, to set a waveguide switch or a coaxial switch.

Such a device is known (EP-A3 0147610and corresponding to U.S. Pat. No. 4,633,201). In this prior art device, the rotor of a waveguide switch is rotated by means of a stepping motor to the vicinity of the desired rotor position and is then definitively moved into the desired rotor position by means of magnetic forces.

Waveguide switches driven by stepping motors have a relatively high weight and large exterior dimensions and require, for three possible positions, two conductor pairs for actuation in addition to an additional control circuit.

SUMMARY OF THE INVENTION

The invention is concerned with effecting the setting into the three positions—seen in one direction of rotation—by way of a single pair of conductors, with low weight and small external dimensions, and to bring the switch rotor exactly into the three desired positions and hold it there without mechanical detent means, which is fraught with problems particularly in the center position but is accomplished by the solution according to the invention.

The device according to the invention is provided with two drive systems for one direction of rotation, both systems being actuated by way of one conductor pair. One drive system rotates the rotor from the one end position into an auxiliary position which is disposed in the vicinity of the one end position. Magnetic detent means move the rotor from the auxiliary position into the center position and center it there.

For switching into the other end position, the other drive system must be actuated by means of the same conductor pair. After switching off the drive system, the rotor is held in the other end position by magnetic detent means.

If, according to a feature of the invention stops are provided in the end positions, the rotor in the end position can be pressed against the stop by the magnetic detent means or can be centered there if, according to still a further feature magnetic centering is provided and stops are connected subsequent to the magnets.

If the rotor is to be moved from this end position into the opposite end position, the other drive systems must be actuated by wa of the other conductor pair: the operation is the same.

The invention will be described below in greater detail in connection with a description of the drawing figures.

BRIEF DESCRIPTION OF THE DRAWINGS

FIG. 6 is a partially developed view of the device in basic outlines.

DETAILED DESCRIPTION OF THE PREFERRED EMBODIMENT

Figure 1:
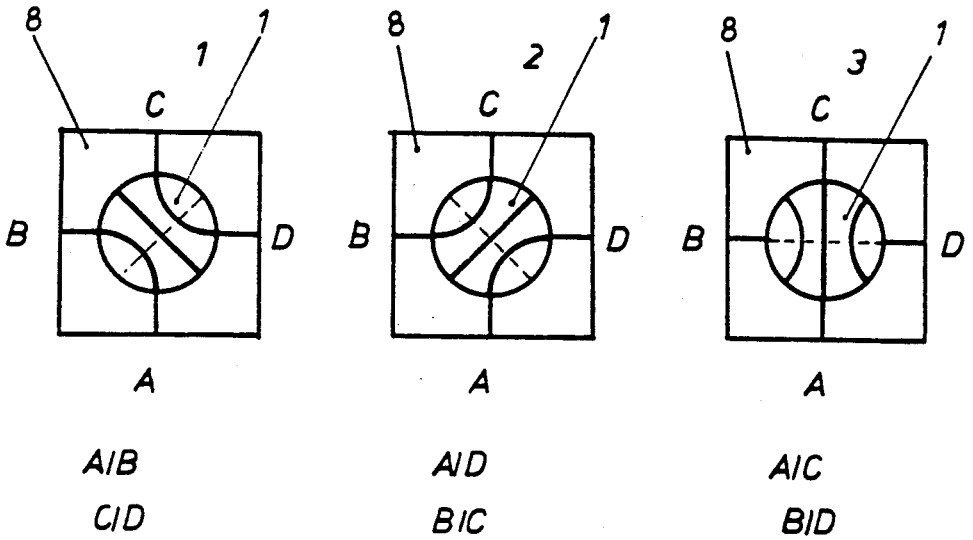
FIG. 1 shows an embodiment of a waveguide switch in basic outlines at its three positions.

FIG. 1 of the drawing is an illustration of the principle of a waveguide switch embodiment in its three positions, Pos. 1, Pos. 2 and Pos. 3. In position Pos. 1, input A is connected with B and input C with D, in position Pos. 2, input B is connected with input C and input A with D and in switch position Pos. 3, input A is connected with input C and input B with D.

Figure 2:
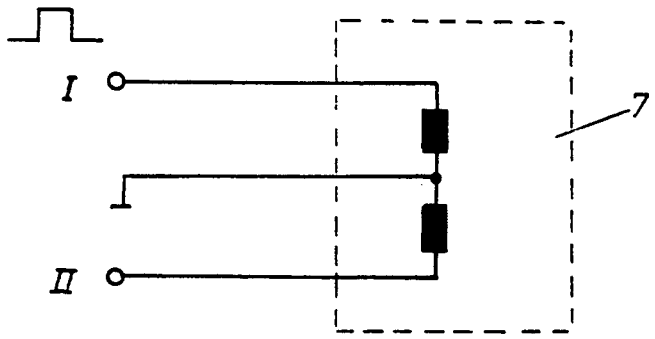
FIG. 2 shows actuation of the waveguide switch by way of the two conductor pairs I and II.
Figure 3:
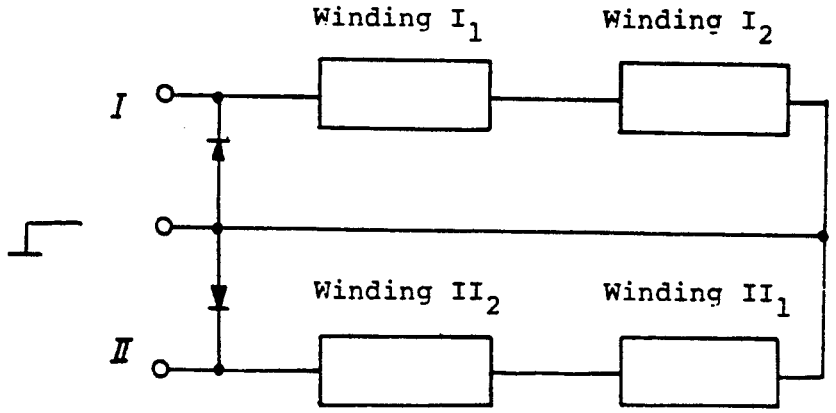
FIG. 3 shows the drive systems for the two directions of rotation.

According to FIG. 2, the waveguide switch 7 is actuated to rotate it in one direction by way of a conductor pair I and in the other direction by way of a conductor pair II, with separate windings being provided for the two directions of rotation. As shown in FIG. 3, the drive systems for the two directions each have two drive windings $I_1$ and $I_2$ as well as $II_1$ and $II_2$, respectively.

Figure 4:
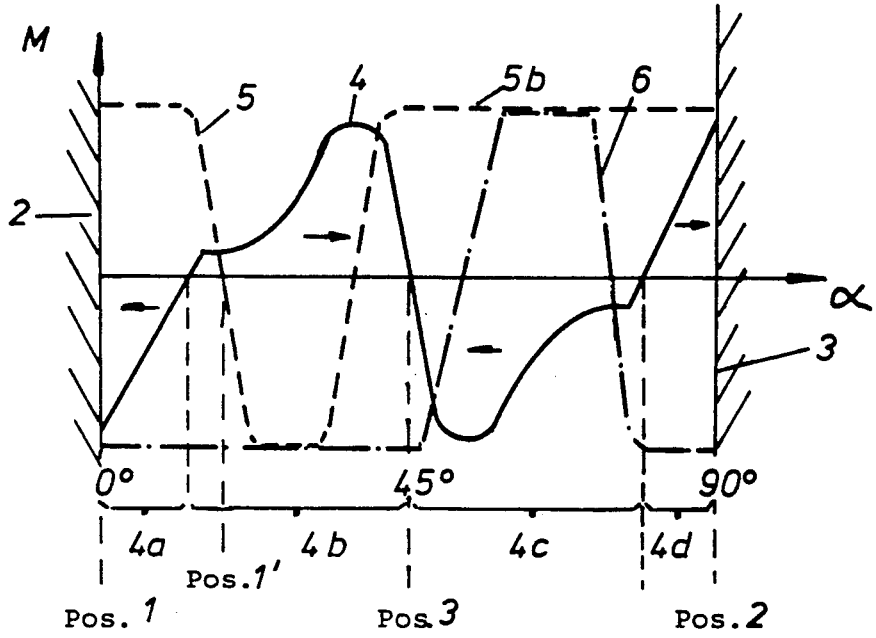
FIG. 4 shows the moment curve of the device plotted over a development of the rotation angle $\alpha$ with stops provided in positions 1 and 2.

According to FIG. 4, which shows the detent moments and the driving moments (M) over a development of the angle of rotation o for the case where the end positions (Pos. 1 and 2) are defined by means of stops 2 and 3, the detent moment curve 4, seen from left to right, is composed initially of a moment (4*a*) which drives the rotor against stop 2 (Pos. 1), then of a curve 4*b* which drives rotor 1 to the right into position 3 and then a curve 4*c* which drives rotor 1 to the left into position 3 and then of a moment (4*d*) which drives rotor 1 to the right toward stop 3 (Pos. 2). The directions of the respective moments acting on the rotor magnet(s) are shown by solidly drawn arrows. The curve of the moment in the region of position 3 is very steep to securely place rotor 1 into position (=Pos. 3) and to hold it there.

A driving moment actuated by a pulse in conductor pair I and acting on rotor 1 in position Pos. 1 according to curve 5 shown in dashed lines, brings rotor 1 into position Pos. 1'. Due to the characteristic of the driving moment, the rotor is held (approximately) in this Pos. 1' as long as there is a driving moment. If the driving moment disappears, the permanently impressed detent moment takes care of further rotating rotor 1 into position 3. Only a renewed pulse in conductor pair I and the moment (5*b*) generated thereby which now acts on rotor 1 brings the rotor into its end position (Pos. 2), i.e. to stop 3 where, due to moment 4*d*, it is held even after the driving pulse is turned off.

For a displacement into the opposite direction, a driving moment 6 corresponding to and directed oppositely to driving moment 5 is required; this is shown in dot dash lines.

Figure 5:
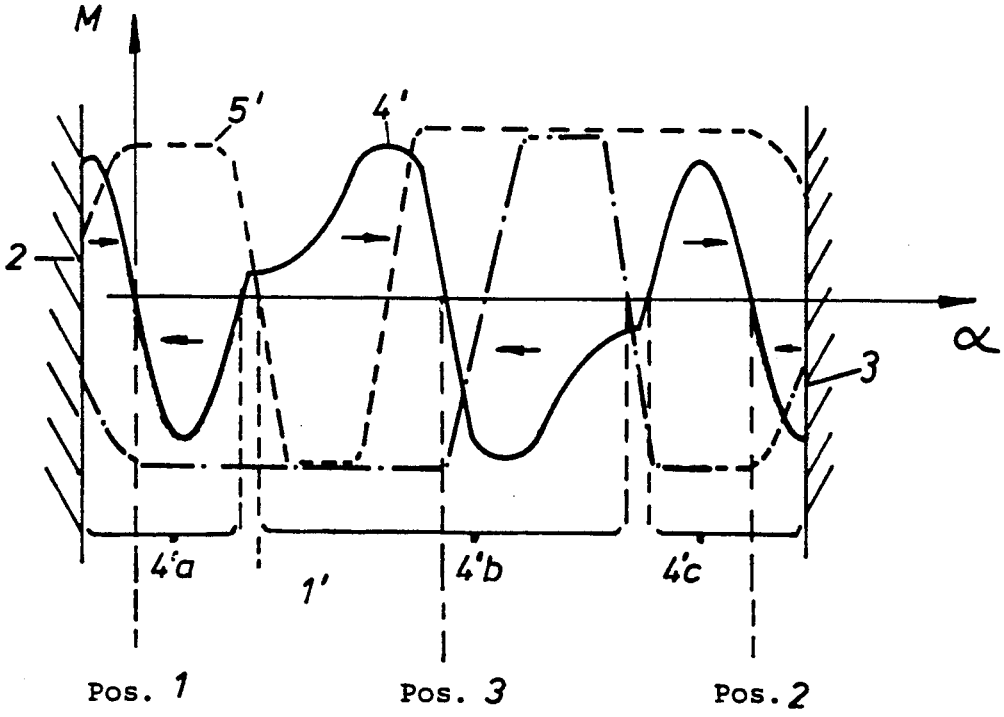
FIG. 5 shows the moment curve of the device plotted over a development of the rotation angle $\alpha$ with stops connected subsequent to positions 1 and 2.

The solution according to FIG. 4 has the advantage that the placement of rotor 1 at stops 2 or 3 permits removal of heat. If this is not necessary, these end positions (Pos. 1 and 2) may also be fixed by magnetic centering but, as a precautionary measure, stops should then preferably be provided subsequent to them. A corresponding moment curve is shown in FIG. 5. In the center region (4'*b*) of the impressed detent moment curve 4', the curve corresponds to that of FIG. 4. However, the end positions (Pos. 1 and 2) are now determined by zero passages (at Pos. 1 and 2) of detent moment curve 4' in regions 4'a and 4'c.

In response to a pulse, the driving moment 5' shown in dashed lines and essentially corresponding to moment curve (5) of FIG. 4 for rotation in the direction of an increasing angle $\alpha$ sets rotor 1—assuming that rotor 1 is in the starting position (Pos. 1)—by means of the first drive system back into the intermediate position (Pos. 1' of, e.g. 15°), from where it is brought by means of the detent moment (4') into Pos. 3. From there, a further pulse brings it into the end position (Pos. 2) by means of the second drive system, with stop 3 preventing the driving moment from rotating rotor 1 too much beyond Pos. 2. In a favorable manner, the driving moment here drops toward stop 3. It is understandable that the driving moment must be great enough in each case to overcome the respective detent moment.

The term "detent moment curve" employed above is intended to identify a moment curve as shown in FIGS. 4 and 5 which is impressed at stator 8 (see FIG. 6a) by the formation and arrangement of permanent magnets 9, 10, 11 (see FIG. 6a) and acts on one or a plurality of the rotor magnets 12 (see FIG. 6a). The magnetic centering for Pos. 3 of FIG. 4 and for positions 1, 2 and 3 of FIG. 5 is realized by a specially configured permanent magnet element 9, 12 (see FIG. 6a). The curve of the driving moment of FIG. 4 is realized by a drive system corresponding to FIG. 6b. For each direction of rotation, different windings $I_1$, $I_2/II_1$, $II_2$ are provided which are associated with different permanent magnet arrangements 13, 14 (see FIG. 6b) on the rotor.

I claim:

1. In a device for setting the rotor of a rotary switch into three possible positions, namely first and second end positions and a center position wherein: drive systems equipped with windings disposed at the stator are actuated to effect this setting, with each drive system being provided with two series-connected windings of which a first winding, if the respective drive system is actuated, rotates the rotor from a momentary one of said end positions into an auxiliary position associated with the center position; a magnetic detent moment curve is active in the auxiliary position and, after the respective drive system has been switched off, centers the rotor in the center position (Pos. 3); and, a respective second winding of each drive system, if the respective drive system is actuated, moves the rotor into the other end position; the improvement wherein: each drive system is actuatable by way of only one conductor pair; the auxiliary position lies closer to the first end position than to the center position; the detent moment curve is configured, by employing an additional permanent magnet on the stator side, so that, in this auxiliary position, after the respective drive system has been switched off, a moment driving in the direction of the center position rotates the rotor into the center position and said rotor is centered there; and each second winding is configured such that it becomes effective if the respective drive system is actuated again and rotates the rotor at least into the vicinity of its second end position.

2. Device according to claim 1 wherein the end positions are determined by stops in which the rotor is held by attraction moments.

3. Device according to claim 1 wherein the end positions are each determined by magnetic centering.

4. Device according to claim 3, wherein stops are provided subsequent to the end positions given by the magnetic centering.

5. Device according to one of claims 1 to 4, wherein the three possible positions are provided at 0°, 45° and 90°.

6. Device according to one of claims 1 to 5, wherein the rotary switch is a waveguide switch.

7. Device according to claim 1 wherein the rotary switch is a coaxial switch.

8. Device according to claim 1 wherein the three possible positions are provided at 0°, 45° and 90°.

* * * * *